US008453302B2

(12) United States Patent
Keyaki et al.

(10) Patent No.: US 8,453,302 B2
(45) Date of Patent: Jun. 4, 2013

(54) SLIDER FOR SLIDE FASTENER

(75) Inventors: Keiichi Keyaki, Toyama (JP); Hideya Take, Toyama (JP)

(73) Assignee: YKK Corporation (JP)

( * ) Notice: Subject to any disclaimer, the term of this patent is extended or adjusted under 35 U.S.C. 154(b) by 222 days.

(21) Appl. No.: 12/936,934

(22) PCT Filed: Apr. 23, 2008

(86) PCT No.: PCT/JP2008/057871

§ 371 (c)(1),
(2), (4) Date: Oct. 8, 2010

(87) PCT Pub. No.: WO2009/130771

PCT Pub. Date: Oct. 29, 2009

(65) Prior Publication Data

US 2011/0258818 A1 Oct. 27, 2011

(51) Int. Cl.
*A44B 19/26* (2006.01)

(52) U.S. Cl.
USPC ..... 24/429; 24/419

(58) Field of Classification Search
USPC ..... 24/381–436
IPC ..... A44B 19/26,19/30, 19/36
See application file for complete search history.

(56) References Cited

U.S. PATENT DOCUMENTS

| | | | | |
|---|---|---|---|---|
| 2,160,160 | A * | 5/1939 | Marinsky et al. | 24/429 |
| 2,495,176 | A * | 1/1950 | Nissen | 24/416 |
| 2,569,076 | A | 9/1951 | Schaye | |
| 3,899,804 | A | 8/1975 | Kawashima | |
| 7,089,632 | B2 * | 8/2006 | Keyaki et al. | 24/429 |
| 2008/0201917 | A1 * | 8/2008 | Lee | 24/429 |
| 2011/0197402 | A1 * | 8/2011 | Keyaki et al. | 24/386 |

FOREIGN PATENT DOCUMENTS

| | | |
|---|---|---|
| GB | 1418224 | 12/1975 |
| GB | 2000220 | 1/1979 |
| JP | 44-21609 | 9/1969 |
| JP | 51-9365 | 3/1976 |
| JP | 54-10305 | 1/1979 |

OTHER PUBLICATIONS

International Search Report, PCT Application No. PCT/JP08/057871, mailed Jul. 22, 2008.

* cited by examiner

*Primary Examiner* — Robert J Sandy
(74) *Attorney, Agent, or Firm* — Kilpatrick Townsend & Stockton LLP

(57) ABSTRACT

A slider for slide fastener has a handle attachment/detachment column part projected upward from an upper face of a slider body and a pair of cantilever engagement pieces formed in a window part of a handle, and they are snap-engaged. An attachment/detachment part of the cantilever engagement piece and the handle attachment/detachment column part is provided with a head storage space (PS) storing and engaging an attachment/detachment head at the time of engaging the cantilever engagement piece and the attachment/detachment head. Thus, attachment/detachment of the handle attachment/detachment column part and the cantilever engagement piece becomes easy and the cantilever engagement piece of the handle is difficult to be damaged. Uncomfortable feeling by a projected end of the handle attachment/detachment column part and hooking of fiber do not exist and durability is given.

6 Claims, 8 Drawing Sheets

SLIDER FOR SLIDE FASTENER

This application is a national stage application of PCT/JP2008/057871, which is incorporated herein by reference.

TECHNICAL FIELD

The present invention relates to a slider for a slide fastener capable of allowing a handle to be releasably fixed on an upper surface of the slider in a laid down state at the time of stopping the slider and capable of easily performing conversion between a stopping manipulation and a sliding manipulation of the slider.

BACKGROUND ART

Conventionally, as a means for engaging a slider in a closed state of a slide fastener, an engagement device is disclosed in, for example, Japanese Utility Model Application Publication (JP-Y) No. 44-21609 (Patent Document 1) or U.S. Pat. No. 2,569,076 (Patent Document 2), where an engagement protrusion is formed to protrude on an upper surface of a top stopper and an engagement hole is formed in the engagement protrusion by puncturing, where the engagement protrusion is inserted into a window hole formed in a handle of the slider and, after that, an engagement means is attached to the engagement hole, thereby fixing, the slider to the top stopper.

If the slider engagement device disclosed in Patent Document 1 or 2 is used for a slider for a slide fastener of a sack containing, for example, shells or the like, the slider is prevented from being moved indiscriminately. Therefore, the slider engagement device can be effectively used so that an accident such as dropout or the like of the shells or the like caused by the spontaneous opening of the slide fastener may be prevented.

However, in such a conventional engagement device, the slide fastener is effective in that, when the slide fastener is in the closed state, the slider is fixed so as to maintain the closed state. In order to open the slide fastener again, the engagement means is released, and the handle is released from the engagement protrusion. By manipulating the handle, the slider is allowed to slide, so that the slide fastener is opened. However, these manipulations are complicated. As a slide fastener which reforms this problem, a slide fastener capable of fixing and releasing the handle to and from the top stopper by simpler manipulation is disclosed in, for example, Japanese Utility Model Application Laid-Open (JP-U) No. 54-10305 (Patent Document 3).

According to Patent Document 3, a window is provided at the center of a handle main body of a handle supported on an upper surface of a slider. In addition, a pair of the left and right cantilever engagement pieces which are formed to extend toward the front end of the handle are provided in the window, and a knob portion is formed at the front end of the handle by folding the free end portion upwards and, after that, bending in the horizontal direction. Since the knob portion is formed, the handle can be easily handled by finger tips. On the other hand, a column part is formed to protrude on an upper surface of the top stopper, and an attachment/detachment head for elastically deforming and engaging the pair of the left and right cantilever engagement pieces so as to be widened is formed at the end portion.

In addition, for example, in Japanese Utility Model Application Publication (JP-Y) No. 51-9365 (Patent Document 4), unlike the aforementioned Patent Document 3, a column part having an attachment/detachment head on the upper portion thereof, which is engaged with a pair of left and right cantilever engagement pieces formed in a window portion of a handle main body, is formed to protrude on the upper surface of the end portion of the rear opening side of the slider body. As a result, although the slider is located at any position of the slide fastener without limitation to the positions where the upper and lower engagement means are located, only if the handle is engaged with the column part, the floating of the handle can be prevented.

Patent Document 1: Japanese Utility Model Application Publication (JP-Y) No. 44-21609

Patent Document 2: U.S. Pat. No. 2,569,076

Patent Document 3: Japanese Utility Model Application Laid-Open (JP-U) No. 54-10305

Patent Document 4: Japanese Utility Model Application Publication (JP-Y) No. 51-9365

DISCLOSURE OF THE INVENTION

Problems to be Solved by the Invention

However, in general, a handle of such a type of a slider for a slider fastener is manufactured by press machining. Therefore, the handles disclosed in the aforementioned Patent Documents 1 to 3 also are manufactured by the press machining. In the handle obtained by the press machining, as described above, the pair of the left and right cantilever engagement pieces are formed at the window portion of the handle, so that the pair of the left and right cantilever engagement pieces may be easily elastically deformed at the time of engaging the opposite column part with the attachment/detachment head. However, the press machining requires high cost for the pressing equipment or maintenance in addition to post machining such as plating or blurring.

On the other hand, similarly to the handle disclosed in Patent Document 4, when the handle having the aforementioned structure is manufactured by die-casting, a post process such as press process is unnecessary, so that a production cost can be greatly lowered. However, as disclosed in Patent Document 4, a product obtained by die-cast molding cannot be easily elastically deformed, and a strong force is inevitably exerted thereto when the handle is attached to or detached from the pair of the left and right cantilever engagement pieces, so that the product can be easily abraded and deformed. In addition, in the slider disclosed in Patent Document 4, any particular consideration is not taken into the attachment/detachment portion between the cantilever engagement piece and the column part, and the aforementioned problems are not solved, so that abrading deformation or plastic deformation may still easily occur.

Further more, recently, applications of a slide fastener for attachment of indoor members or a seat cover of a general car or the like have been actively researched. However, if particularly a handle of a slider of the slide fastener is freely moved when the slide fastener is provided, there is a problem in terms of an outer appearance, as well as a problem in that repetitive contacting between the slider body and the handle due to vibration makes an unpleasant sound. In addition, when the opening or closing manipulation is ended, it is required that the handle and the slider are in a non-moved state with a predetermined posture.

On the other hand, in Patent Documents 1 to 4, although each of the handles is configured to be able to be attached and detached through the column part in the engagement means or the slider body, the height of the column part which is attached to or detached from the pair of the left and right cantilever engagement pieces is too high. In addition, the slider is manufactured by taking into consideration that, when the handle is engaged with the column part, locking is performed by inserting a key into a through hole formed in the column part. Therefore, the upper end of the column part is formed to greatly protrude upward from the handle. Accordingly, when the protruding portion of the upper end of the column part is in contact with a human body or a cloth, a problem such as a pricking feeling or a scratch of a cloth or a fiber may occur.

The present invention is contrived by taking into consideration the above problems. More specifically, an object of the present invention is to provide a slider for a slide fastener having at least a handle formed as a die-cast product, in which a pair of the left and right cantilever engagement pieces is formed in a window portion of a handle main body and in which a column part having an attachment/detachment head which is attached to or detached from the cantilever engagement pieces is formed to protrude on an upper surface of an end portion of a rear opening side of a slider body, capable of allowing the cantilever engagement pieces and the column part to be easily detached from each other, preventing unpleasant feeling, a scratch of a fiber, or the like caused by the column part, and having durability.

Means for Solving the Problems

The reason why the abrading deformation, plastic deformation, or the like still easily occurs in the slider disclosed in Patent Document 4 has been actively examined. As a result, in the slider disclosed in Patent Document 4, the height of the column part engaged with the handle is large. In addition, particularly, the length from the upper end to the neck portion is long, so that, at the time of attaching or detaching the handle, a strong deformation force of the handle is exerted to the pair of the left and right cantilever engagement pieces. Therefore, it is found that the elastic deformation may be easily converted into the plastic deformation. In addition, it is found that an amount of abrasion is increased. In order to effectively achieve the aforementioned object, firstly the reduction in a deformation force and the shortening of a deforming time at the time of attaching or detaching of the handle to or from the column part are needed, and a pricking feeling or a scratch of a fiber caused by the upper end of the column part needs to be removed.

As a basic configuration of the present invention, there is provided a slider for a slide fastener, as a die-cast product, having a slider body and a handle of which the one end is supported by a pivot supporting portion on an upper surface of the slider body, wherein a window portion is formed in a handle main body of the handle, wherein a pair of the left and right cantilever engagement pieces are disposed to extend from one of inner edge portions of the window portion toward the facing inner edge portion, and wherein an attachment/detachment column part having an attachment/detachment head which is attached to or detached from the pair of the left and right cantilever engagement pieces in a snapped shape is disposed to protrude at least at a rear opening side on the upper surface of the slider body, wherein the pair of the left and right cantilever engagement pieces have engagement portions with respect to the attachment/detachment head at the facing inner side surfaces thereof, and wherein the engagement portions are configured to have a head receiving space which receives and the attachment/detachment head at the time of engaging each of the cantilever engagement pieces with the attachment/detachment head.

In a preferred aspect of the present invention, a height of the upper surface of the handle attachment/detachment column part from the upper surface of the slider is set to be equal to a height of the upper surface of the handle main body when the handle main body is engaged with the handle attachment/detachment column part. In addition, the engagement portion is configured to have protrusions which are formed at free end portions of the pair of the left and right cantilever engagement pieces so as to protrude to approach each other or at least each of the free end portions of the pair of the left and right cantilever engagement pieces is configured to have a slanted plane, which is slanted downward, formed on the facing inner side surface. It is preferable that, the head receiving space is formed between the left and right slanted planes. In addition, in another preferred aspect of the present invention, it is preferable that a thickness between front and rear surfaces of the cantilever engagement piece is formed to be equal to a thickness between front and rear surfaces of the handle main body or to be smaller than the thickness between the front and rear surfaces of the handle main body. In order to form the head receiving space, the height of the upper surface of the handle attachment/detachment column part from the upper surface of the slider and the thickness between the front and rear surfaces of the cantilever engagement piece may be appropriately set. In addition, the attachment/detachment column part may be disposed on the upper surface of at least the rear opening side of the slider body. In some cases, an attachment/detachment column part having the same structure of the aforementioned attachment/detachment column part may be disposed on the upper surface of a shoulder top side of the slider body.

Effect of the Invention

In the present invention, when each the cantilever engagement pieces is engaged with the attachment/detachment head, the cantilever engagement piece and the attachment/detachment head are designed so as to receive the attachment/detachment head within the head receiving space between the engagement portions formed at the free end portions of the cantilever engagement portions. Therefore, when the cantilever engagement pieces are detached from the attachment/detachment head, a relative sliding distance between each of the cantilever engagement pieces and the attachment/detachment head is inevitably shortened, so that an amount of abrasion caused by the attachment/detachment manipulations can be reduced. In addition, at the same time, the upper end of the column part is not formed to greatly protrude upward from the surface of the handle main body, so that a pricking feeling or a scratch of a fiber may not be caused by the upper end of the column part.

Like the more preferred aspect, when the protrusions which approach each other are disposed to the free end portions of the pair of the left and right cantilever engagement pieces, a contact area between the each of protrusions and the column part is designed to be as small as possible, so that a frictional force therebetween can be greatly reduced. Accordingly, an amount of abrasion is also greatly decreased. As a result, durability can be further improved. In order to allow the contact area between each of the protrusions and the column part to be very small, as described above, it is preferable that slanted planes which are slanted downward may be formed in the facing inner sides of at least the free end portions of the pair of the left and right cantilever engagement pieces.

In addition, if the thickness between the front and rear surfaces of the cantilever engagement piece is set to be smaller than the thickness between the front and rear surfaces of the handle main body, the cantilever engagement piece is always disposed at a position lower than the upper surface of the handle main body, so that an external force cannot be indiscriminately exerted to the cantilever engagement piece, and damage caused by the external force can be reduced. In addition, a receiving space for the attachment/detachment head can be easily formed in the engagement portion.

When the attachment/detachment column part is provided on the upper surface of the shoulder top side of the slider body, at the time of closing the slide fastener, the handle is engaged with the handle attachment/detachment column part, so that the floating of the handle can be prevented. Therefore, adjacent members cannot be snatched by the handle, so that it is possible to prevent the slider from indiscriminately sliding on the slide fastener. Accordingly, a task of installing, for example, a seat cover or the like can be easily performed.

Although a die-cast product which cannot easily elastically deformed is used as the handle, if the slider has the aforementioned structure, it is possible to reduce the sliding range and the sliding time at the time of attaching or detaching the cantilever engagement pieces to or from the handle attachment/detachment column parts, so that abrasion resistance can be improved. In addition, at the same time, since the left and right expansion/contraction sizes of the cantilever engagement piece can be suppressed to the minimum, even in the case of repetitive attachment/detachment manipulations, the so-called shear drop cannot easily occur, and the durability of the slider can be greatly increased.

REFERENCE NUMERALS

10: slider
11: slider body
11-1: upper wing plate
11-2: lower wing plate
11-3: connection column
11-4: pivot supporting portion
11-5: flange
11-6: nail hole
11-8: handle attachment/detachment column part
**11-8*a***: head portion
**11-8*b***: attachment/detachment head
**11-8*b*'**: inverse echelon portion
**11-8*b*"**: rectangular portion
**11-8*c***: first handle attachment/detachment column part
**11-8*d***: second handle attachment/detachment column part
11-9: element guide passage
12: handle
12-1: pivot shaft
12-2: stopping nail piece
12-3: handle main body
12-4: beam part
12-5: cantilever engagement piece
12-6: lower frame
12-7: protrusion
**12-7*a***: first slanted plane
**12-7*b***: second slanted plane
12-8: pivot shaft part
12-9: slanted plane
PS: attachment/detachment head receiving space
CP: intersection

BEST MODE FOR CARRYING OUT THE INVENTION

Figure 1:
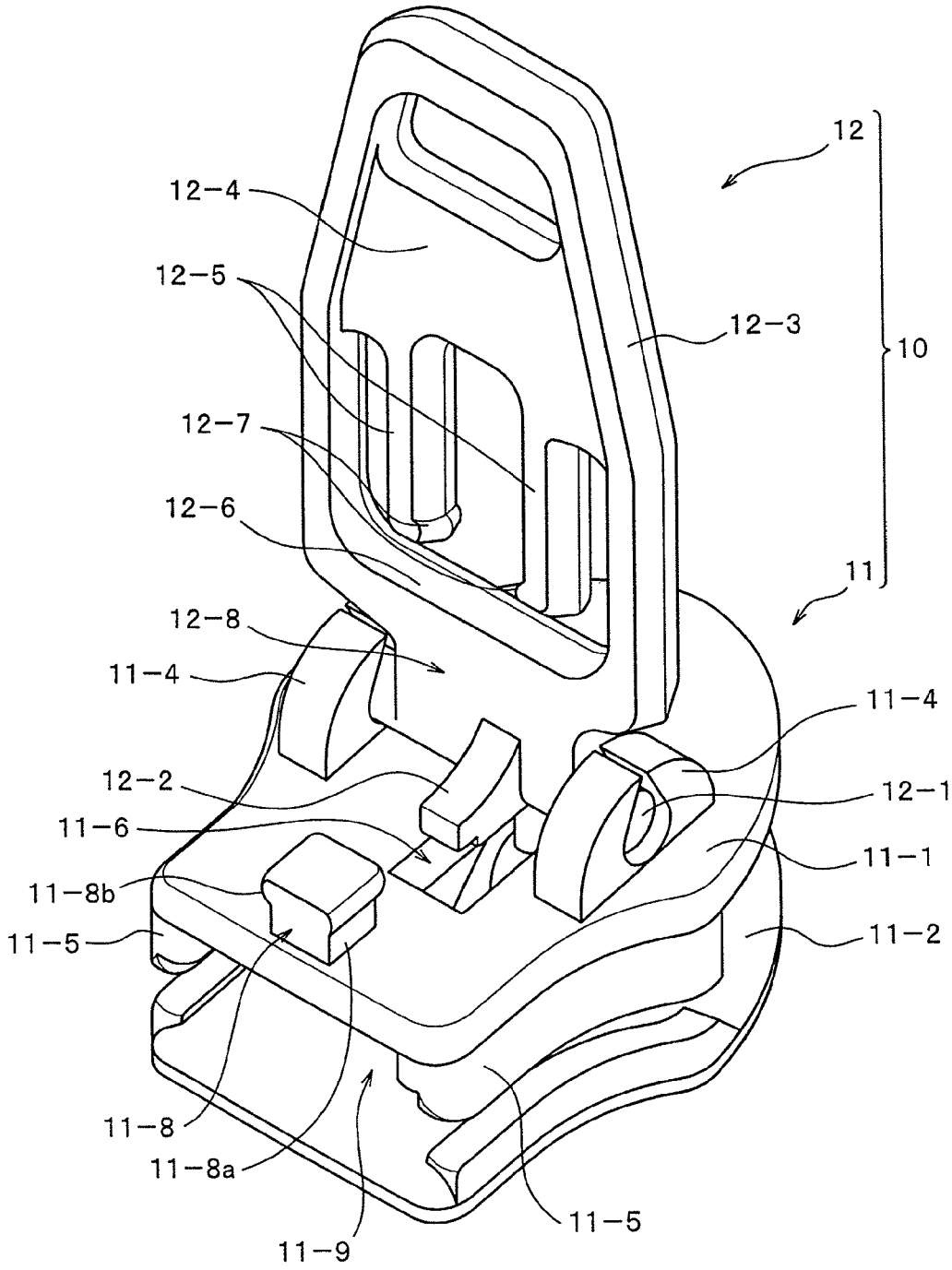
FIG. 1 is a perspective view illustrating a slider for a slide fastener at the time of erecting a handle as seen from a rear portion of a rear opening side thereof according to an representative example of the present invention.
Figure 2:
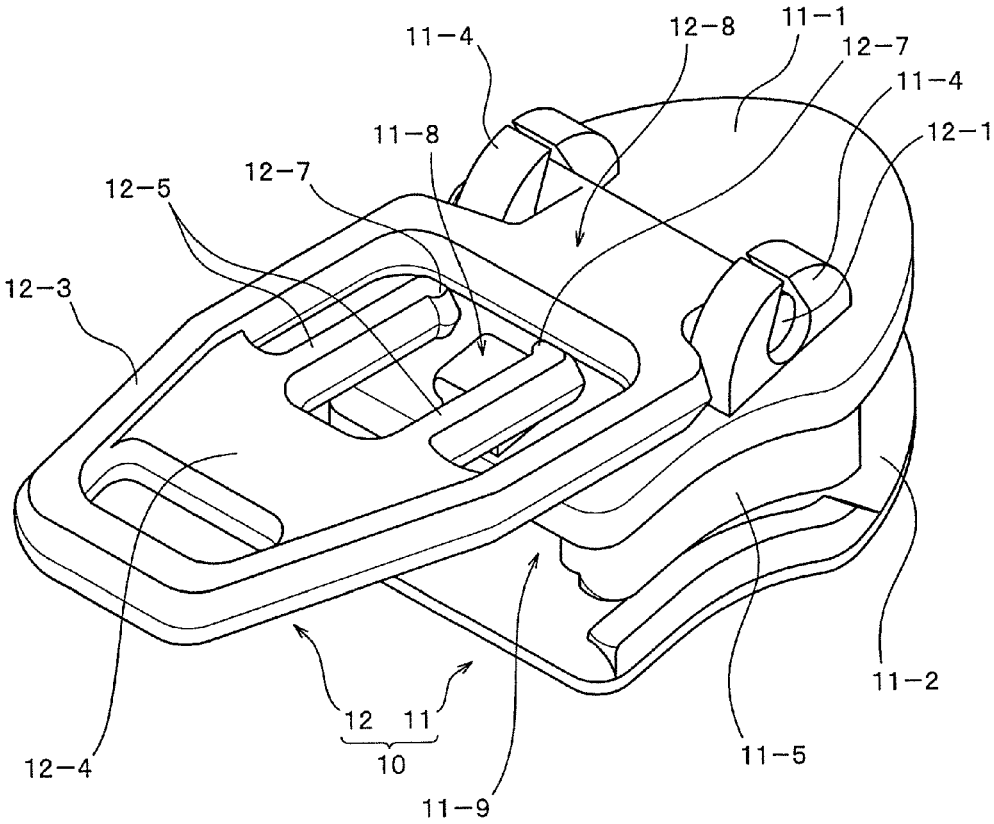
FIG. 2 is a perspective view illustrating the slider for a slide fastener at the time of laying the handle down as seen from the rear portion of the rear opening side thereof.

Hereinafter, preferred embodiments of the present invention will be described more in detail with reference to the accompanying drawings. FIGS. 1 to 9 illustrate a first example of the present invention. FIGS. 1 and 2 are outer appearance views of a slider 10 according to the first example. As illustrated in FIGS. 1 and 6, the slider 10 according to the first example is constructed with a slider body 11 and a handle 12.

The slider body 11 has an upper wing plate 11-1 and a lower wing plate 11-2. The shoulder-top-side end portion of the upper wing plate 11-1 and the shoulder-top-side end portion of the lower wing plate 11-2 are connected to each other with a predetermined interval by a connection column 11-3. Pivot supporting portions 11-4 for supporting a pivot shaft 12-1 of the handle 12 are configured to protrude at the left and right sides of an approximately central upper surface of the upper wing plate 11-1. Left and right flanges 11-5 are disposed in the left and right side edges of the upper wing plate 11-1 to extend toward the lower wing plate 11-2. In addition, a nail hole 11-6, into which a stopping nail piece 12-2 protruding from the handle 12 is inserted, is formed at a position which is deflected in any one of the left and right directions adjacent to the inner side of the pivot supporting portion 11-4 of the upper wing plate 11-1. This configuration of the slider body 11 is substantially the same as a well-known configuration.

Figure 3:
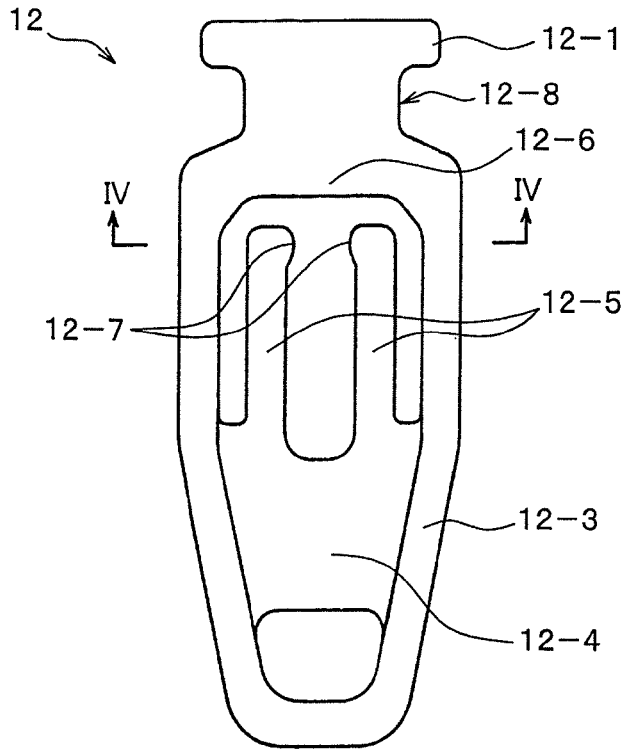
FIG. 3 is a plan view illustrating the handle of the slider for a slide fastener.

A handle attachment/detachment column part 11-8 constituting a portion of characteristics of the present invention is disposed at the center of the rear opening side upper surface of the slider body 11 having such a configuration to protrude upward. On the other hand, as illustrated in FIGS. 1 and 3, the handle 12 is configured as a substantially rectangular frame so that the entire of the handle main body 12-3 is configured as a vertically-long hexagonal shape. A beam part 12-4 is disposed to connect the left and right frame portions near to the upper end portion in the long direction (the up-down direction of FIG. 1) within the frame corresponding to a window portion according to the present invention, in the handle main body 12-3. Two cantilever engagement pieces 12-5 are disposed to extend in parallel to each other from the lower surface of the beam part 12-4 toward a lower frame 12-6. The cantilever engagement pieces 12-5 together with the handle attachment/detachment column part 11-8 of the slider body 11 constitute main characteristics of the present invention. According to the example illustrated, protrusions 12-7, which are formed to protrude in the direction so as to approach each other in the shape illustrated in FIG. 3, are disposed on the facing side surfaces of the free end portions of the two cantilever engagement pieces 12-5.

In addition, in FIG. 1, an inverted-T shaped pivot shaft part 12-8 having the pivot shaft 12-1 at the front end portion is disposed in the central lower surface of the frame 12-6 disposed at the lower end of the handle main body 12-1 to extend downward. The stopping nail piece 12-2 is configured to protrude to the position of the pivot shaft part 12-8 corresponding to the nail hole 11-5 formed the slider body 11 at the time of laying the handle 12 down toward the rear portion.

Figure 4:
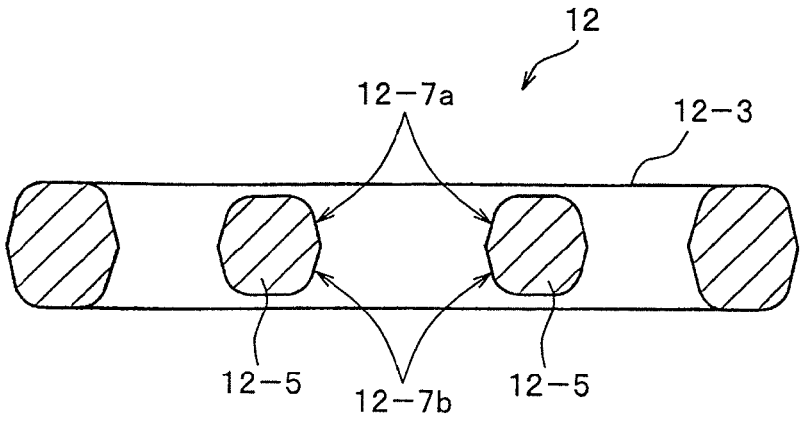
FIG. 4 is a cross-sectional view taken along line IV-IV of FIG. 3.
Figure 5:
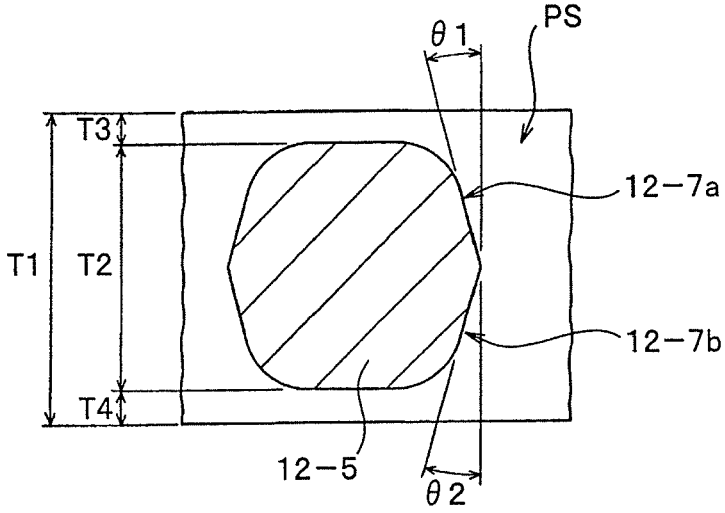
FIG. 5 is a partial cross-sectional view illustrating a relationship between sizes of a handle main body and a cantilever engagement piece.
Figure 6:
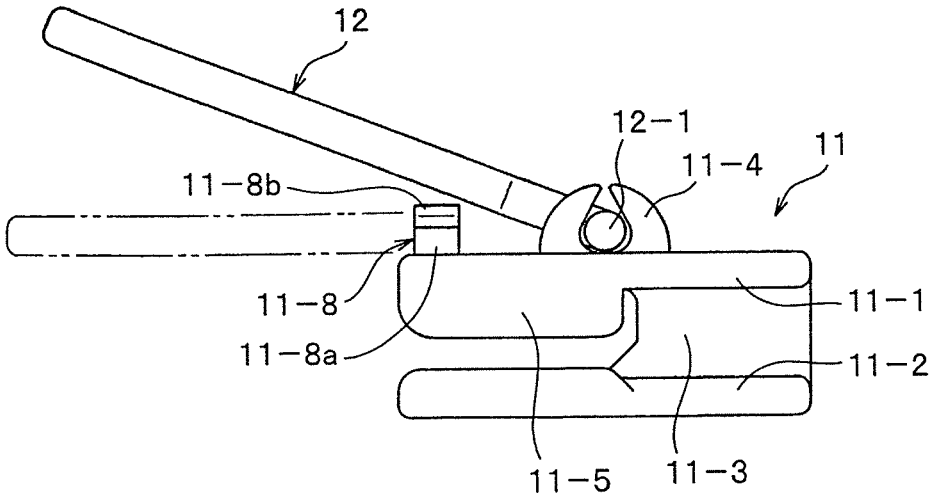
FIG. 6 is a view for explaining attachment/detachment manipulations of the handle on the slider.

FIGS. 4 and 5 illustrate cross-sectional shapes of the handle main body 12-3 and the protrusions 12-7 of the cantilever engagement pieces 12-5 in detail in the example. As illustrated in the figures, a thickness between front and rear surfaces (upper and lower portions in FIGS. 4 and 5) of each of the cantilever engagement pieces 12-5 is configured to be smaller than a thickness between front and rear surfaces of the handle main body 12-3. Now, as illustrated in FIG. 5, if the thickness between the front and rear surfaces of the cantilever engagement pieces 12-5, the thickness between the front and rear surfaces of the handle main body 12-3, a distance between the front surface of the cantilever engagement piece 12-5 and the front surface of the handle main body 12-3, and a distance between the rear surface of the cantilever engagement piece 12-5 and the rear surface of the handle main body 12-3 are defined by T2, T1, T3, and T4, respectively, the values thereof are set so that T1>T2 and T3=T4. In addition, as illustrated in FIG. 5, each of the facing surfaces of the protrusions 12-7 of the cantilever engagement pieces 12-5 is configured to have a first slanted plane 12-7*a* which is slanted downward from the front surface with an angle θ1 and a second slanted plane 12-7*b* which is slanted upward from the rear surface with an angle θ2. Herein, a relationship between the slanted angles θ1 and θ2 of the first slanted plane 12-7*a* and the second slanted plane 12-7*b* is set to θ1=θ2, which is set to about 15 degrees.

Figure 7:
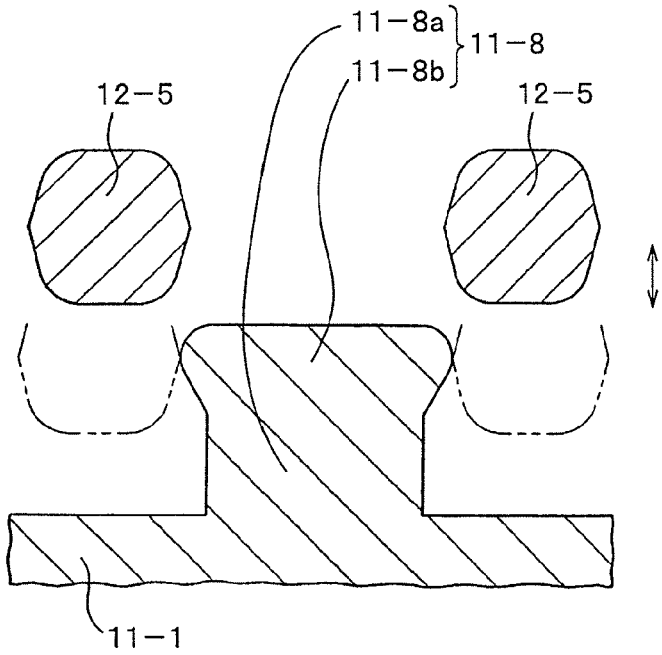
FIG. 7 is a cross-sectional view for explaining attachment/detachment manipulations of the cantilever engagement piece of the handle with respect to a handle attachment/detachment column part of the slider.
Figure 8:
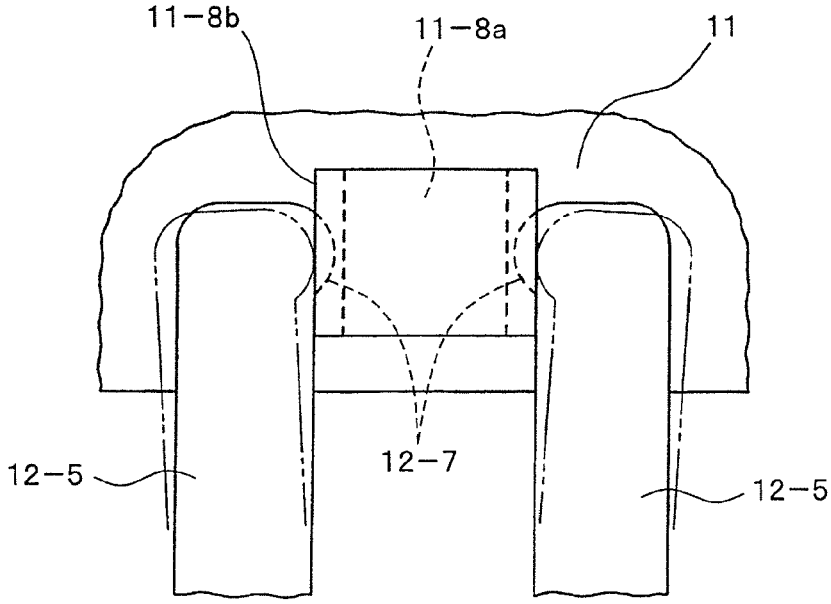
FIG. 8 is a plan view for explaining the attachment/detachment manipulations of the cantilever engagement piece of the handle with respect to the handle attachment/detachment column part of the slider.
Figure 9:
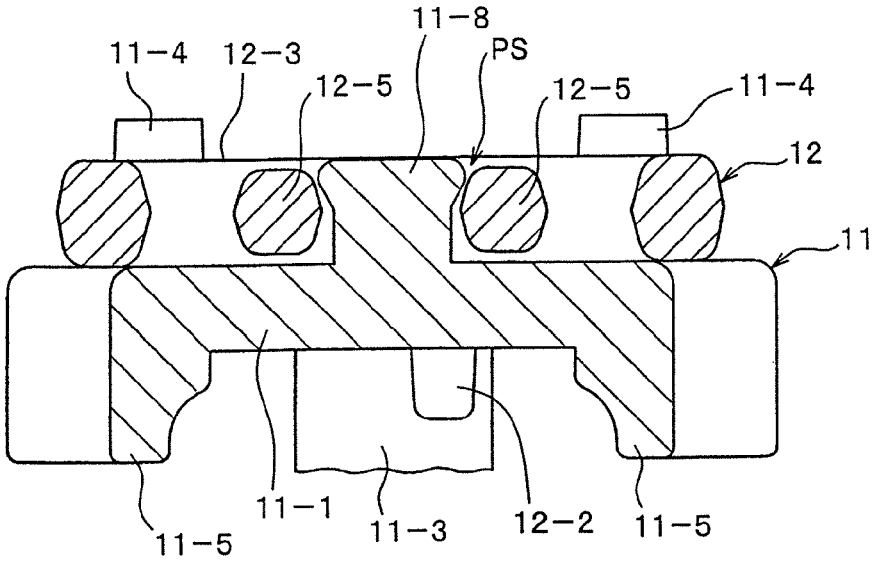
FIG. 9 is a view for explaining a state at the time of engaging the handle attachment/detachment column part of the slider with the cantilever engagement piece of the handle.

With respect to the handle main body 12-3 having such a configuration, as illustrated in FIGS. 7 to 9, the attachment/detachment column part 11-8, which is attached to or detached from the cantilever engagement pieces 12-5 of the handle main body 12-3, is configured to have a head portion 11-8*a* which is formed as a regular hexahedron erecting from the upper surface of the slider body 11 and an attachment/detachment head 11-8*b* which is formed on the upper end of the head portion 11-8*a*, of which the front and rear sizes (upper and lower sizes in FIG. 8) are set to be equal to the sizes of the head portion 11-8*a*, of which the left and right sizes are set to be larger than the left and right sizes of the head portion 11-8*a*, and which is expanded in the left and right directions from the left and right ends of the head portion 11-8*a* as illustrated in FIG. 7. The attachment/detachment head 11-8*b* is configured to have a flat upper surface and left and right end portions which are expanded from the left and right ends so as to become an arch plane and to be continuous with the down-slanted plane which is straightly slanted downward. The lower end of the down-slanted plane interests the head portion 11-8*a*.

As illustrated in FIG. 9, a vertical height of the handle attachment/detachment column part 11-8 is set to be equal to a height of the surface of the handle main body 12-3 when the handle 12 is laid down to the rear opening side around the pivot shaft 12-1 so as to be engaged with the handle attachment/detachment column part 11-8. In the example, the configuration denotes that a height of the upper surface of each of the protrusions 12-7 of the cantilever engagement pieces 12-5 is smaller than the height of the upper surface of the attachment/detachment head 11-8*b* of the handle attachment/detachment column part 11-8. However, it is not a necessary configuration that the height of the upper surface of each of the protrusions 12-7 of the cantilever engagement pieces 12-5 is set to be smaller than the height of the upper surface of the attachment/detachment head 11-8*b* of the handle attachment/detachment column part 11-8. For example, when the height of the upper surface of each of the protrusions 12-7 is set to be equal to the height of the upper surface of the handle main body 12-3, the length between the upper and lower portions of the upper slanted plane of each of the left and right side surfaces of the protrusions 12-7 may be set to be larger than the length between the upper and lower portions of the lower slanted plane. In this case, the height of the upper surface of the handle attachment/detachment column part 11-8 is also set to be smaller than the height of the upper surface of the handle main body 12-3. In addition, as illustrated in FIG. 8, the planar shape of the attachment/detachment head 11-8*b* is the same as the rectangular shape of the head portion 11-8*a*.

In a slide fastener provided with the slider 10 having the aforementioned configuration according to the example, when the slider is located at an arbitrary position, in order to stop the slider 10 at the arbitrary position on the slide fastener and at the same time in order to engage the cantilever engagement pieces 12-5 of the handle main body 12-3 with the handle attachment/detachment column part 11-8 of the slider body 11, the handle main body 12-3 is first allowed to be laid down to the rear opening side of the slider body 11 as indicated by the arrow in FIG. 7. Due to the laying down, the stopping nail piece 12-2 which is formed to protrude from the rear surface side of the handle main body 12-3 is inserted into the nail hole 11-6 formed in the upper wing plate 11-1 of the slider body 11, and as illustrated in FIG. 9, the front end of the stopping nail piece 12-2 is projected down from the nail hole 11-6 to invade between elements (not shown) which passes an element guide passage 11-9 of the slide fastener formed between the upper wing plate 11-1 and the lower wing plate 11-2, so that the sliding of the slider 10 cannot be performed.

When the handle main body 12-3 is allowed to be laid down to the rear opening side of the slider body 11, if the amount of the laying down is set to be larger, the cantilever engagement pieces 12-5 of the handle main body 12-3 allows the interval between the left and right portions to be gradually increased and widened while being moved from the position indicated by the solid line in FIG. 7 to the position indicated by a virtual line. As a result, like a conventional slider, the left and right cantilever engagement pieces 12-5 do not continuously elastically deformed with a large amount of deformation for a long time, and the state of being widened to the maximum can be obtained for a short time. The useless deforming time is not taken for the cantilever engagement pieces 12-5, so that it is possible to ensure the elastic deformation of the cantilever engagement pieces 12-5 for a long time. In addition, as illustrated in the figure, first, although the second slanted plane 12-7*b* of each of the left and right cantilever engagement pieces 12-5, which is slanted downward, is sliding in contact with the attachment/detachment head 11-8*b* of the handle attachment/detachment column part 11-8, since the protrusions 12-7 of the cantilever engagement pieces 12-5 and the attachment/detachment head 11-8*b* are formed to have the aforementioned shapes, the contact is approaching to the dotted shapes illustrated in FIGS. 7 and 8. In addition, since the time required for widening the width between the left and right cantilever engagement pieces 12-5 is shortened, an amount of abrasion of the cantilever engagement pieces 12-5 caused by the engagement manipulation can be greatly reduced.

If the front end of the handle main body 12-3 is further pressed down, the protrusions 12-7 of the cantilever engagement pieces 12-5 return to the original positions due to the elastic restitution along the down-slanted plane of the attachment/detachment head 11-8*b*. In this case, since the protrusions 12-7 of the cantilever engagement pieces 12-5 and the attachment/detachment head 11-8*b* of the handle attachment/detachment column part 11-8 are also in contact with each other in the aforementioned dotted shapes, as illustrated in FIG. 9, finally, the head portion 11-8*a* of the handle attachment/detachment column part 11-8 is inserted between the protrusions 12-7 of the cantilever engagement pieces 12-5, so that the handle main body 12-3 is engaged and fixed to the handle attachment/detachment column part 11-8. Accordingly, the handle main body 12-3 cannot be floated from the upper surface of the slider 10.

In addition, in the example, at the time of engaging the cantilever engagement pieces 12-5 with the attachment/detachment head 11-8*b*, since the height of the upper surface of the handle attachment/detachment column part 11-8 is set to be equal to the height of the upper surface of the handle main body 12-3 and to be larger than the height of the upper surface of each of the protrusions 12-7 of the left and right cantilever engagement pieces 12-5, a head receiving space PS which can entirely receives the attachment/detachment head 11-8*b* can be formed between the handle main body 12-3 and the cantilever engagement pieces 12-5. In this manner, the cantilever engagement pieces 12-5 and the attachment/detachment head 11-8*b* are designed so as to entirely receive the attachment/detachment head 11-8*b* within the head receiving space PS. Therefore, when the cantilever engagement pieces 12-5 is attached to or detached from the attachment/detachment head 11-8*b*, a relative sliding distance between each of the cantilever engagement pieces 12-5 and the attachment/detachment head 11-8*b* is inevitably shortened, and the contact area is also decreased, so that an amount of abrasion caused by the attachment/detachment manipulations of the handle 12 can be greatly reduced. In addition, at the same time, the upper end of the handle attachment/detachment column part 11-8 is not formed to greatly protrude upward from the surface of the handle main body 12-3, so that a pricking feeling or a scratch of a fiber may not caused by the upper end of the column part. In addition, it is preferable that a height of the upper surface of the handle attachment/detachment column part 11-8 is set to be in a range of ±0.5 to 1 mm of a height of the upper surface of the handle main body 12-3.

In addition, if the thickness between the front and rear surfaces of each of the cantilever engagement pieces 12-5 is set to be smaller than the thickness between the front and rear surfaces of the handle main body 12-3, the cantilever engagement piece 12-5 is always disposed at a position inside the front plane of the handle main body 12-3, so that an external force cannot be indiscriminately exerted to the cantilever engagement piece 12-5, and damage caused by the external force can be reduced. In addition, the aforementioned receiving space PS for the attachment/detachment head 11-8*b* can be easily formed in the engagement portion of the cantilever engagement piece 12-5.

Figure 10:
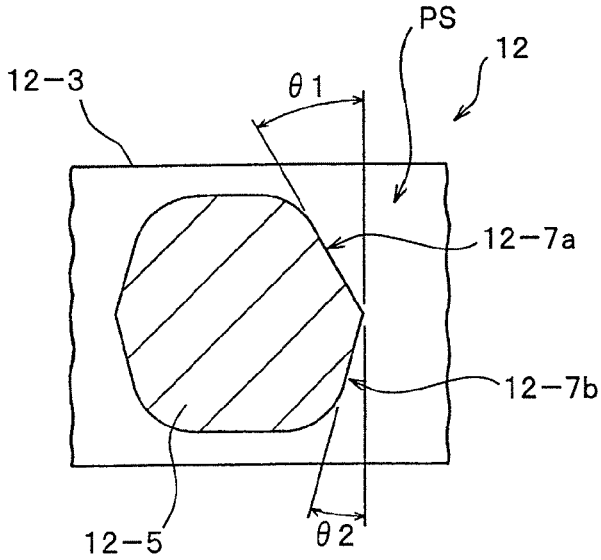
FIG. 10 is a cross-sectional view illustrating a modified example of the cantilever engagement piece.

FIG. 10 illustrates a modified example of the cantilever engagement pieces 12-5. According to the modified example, with respect to the shapes of the facing side surfaces of the protrusions 12-7 which are formed to protrude from the engagement portions of the left and right cantilever engagement pieces 12-5 so as to approach each other, a relationship between the slanted angles θ1 and θ2 of the first slanted plane 12-7*a* and the second slanted plane 12-7*b* is set to θ1>θ2. Herein, the slanted angle θ1 of the first slanted plane 12-7*a* is set to 30 degrees, and similarly to the aforementioned example, the slanted angle θ2 of the second slanted plane 12-7*b* is set to 15 degrees. In this manner, the slanted angle θ1 of the first slanted plane 12-7*a* is set to larger than the slanted angle θ2 of the second slanted plane 12-7*b*, so that it is possible to increase the sizes of the expanding portions of the left and right end portions of the attachment/detachment head 11-8*b* of the handle attachment/detachment column part 11-8. Therefore, an engagement force between each of the cantilever engagement pieces 12-5 and the attachment/detachment head 11-8*b* can be strengthened in comparison with the aforementioned example.

Figure 11:
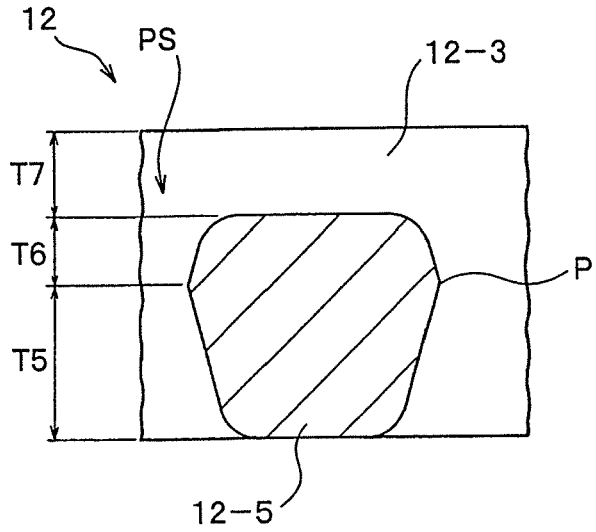
FIG. 11 is a cross-sectional view illustrating another modified example of the cantilever engagement piece.

FIG. 11 illustrates another modified example of the cantilever engagement pieces 12-5. According to the modified example, as illustrated in the figure, the highest-protruding vertex position P of the protrusion 12-7 of the cantilever engagement piece 12-5 is set to the same position as the aforementioned example, and the lower surface of the cantilever engagement pieces 12-5 is set to be coincident with the lower surface of the handle main body 12-3. In other words, in FIG. 11, the distance between the vertex position P and the lower surface of the protrusion 12-7 is denoted by T5; the distance between the vertex position P and the upper surface of the protrusion 12-7 is denoted by T6; and the distance from the upper surface of the protrusion 12-7 to the upper surface of the handle main body 12-3 is denoted by T7. In this case, although a total thickness (T5+T6) of the cantilever engagement piece 12-5 is the same as the thickness in the aforementioned example, since T5>T6, the distance T7 from the upper surface of the protrusion 12-7 to the upper surface of the handle main body 12-3 is larger than the corresponding distance T3 (refer to FIG. 5) in the aforementioned example. According to the configuration, it is possible to increase the size of the attachment/detachment head 11-8*b* of the handle attachment/detachment column part 11-8 in comparison with the aforementioned example.

Figure 12:
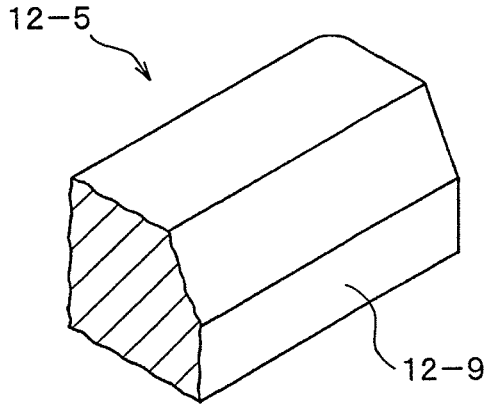
FIG. 12 is a cross-sectional view illustrating still another modified example of the cantilever engagement piece.
Figure 13:
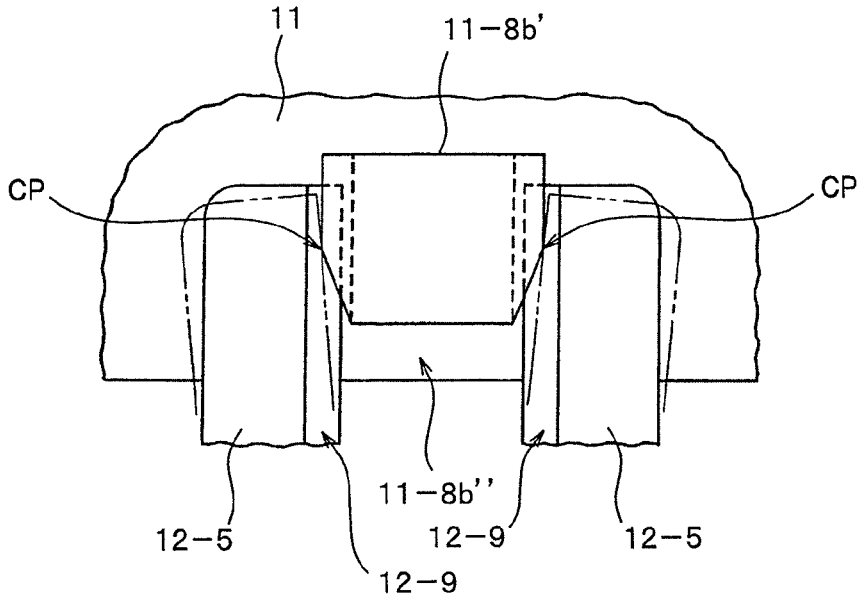
FIG. 13 is a view for explaining attachment/detachment manipulations at the time of engaging the handle attachment/detachment column part with the cantilever engagement piece of the handle according to the modified example.

FIGS. 12 and 13 illustrate a modified example of the attachment/detachment head 11-8*b* and the cantilever engagement pieces 12-5 of the handle attachment/detachment column part 11-8. According to the modified example, the engagement portion with respect to the attachment/detachment head 11-8*b* in the cantilever engagement piece 12-5 is modified, and the engagement structure of the attachment/detachment head 11-8*b* which is attached to or detached from the engagement portion is modified. In addition, the engagement portion of the cantilever engagement piece 12-5 may be formed entirely over the total length of the cantilever engagement piece 12-5 or locally in the region for forming the protrusions 12-7 in the aforementioned example. In the illustrated example, the engagement portion is configured with the slanted planes 12-9 which are slanted downward from the upper surfaces of the left and right cantilever engagement pieces 12-5 to the central positions of the facing side surfaces. By employing such a configuration, the slanted planes 12-9 are included in the engagement portion, so that the cantilever engagement pieces 12-5 can be easily molded.

On the other hand, as illustrated in FIG. 13, the attachment/detachment head 11-8*b* of the handle attachment/detachment column part 11-8 is formed in a horizontally-long pentagonal shape, as seen from a plane, in which an inverse echelon portion 11-8*b*' and a rectangular portion 11-8*b*" is integrally connected at the bottom side. According to the configuration, when the cantilever engagement pieces 12-5 are engaged with the attachment/detachment head 11-8*b*, a pressing force caused by intersections CP between the inverse echelon portion 11-8*b*' and the rectangular portion 11-8*b*" of the inverse echelon shaped attachment/detachment head 11-8*b* is exerted to slanted planes of the straight cantilever engagement pieces 12-5, so that the left and right cantilever engagement pieces 12-5 are gradually extended in a widening direction. At the positions exceeding the slanted planes, the cantilever engagement pieces are straightly lifted down from the intersections CP. At the time of riding over the attachment/detachment head 11-8*b*, the cantilever engagement pieces 12-5 return to the original shape due to the elastic restitution. In the modified example, there is no change in the operations and effects obtained from the configuration in comparison with the aforementioned example or the modified example.

Figure 14:
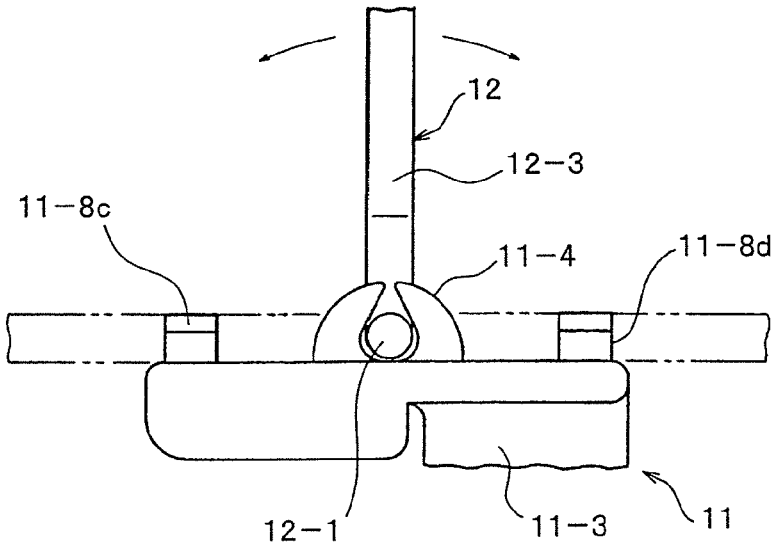
FIG. 14 is a view for explaining attachment/detachment manipulations of a handle according to another example of the present invention.

FIG. 14 illustrates another example of the present invention. According to the example, unlike the embodiments and the comparative examples illustrated in FIGS. 1 to 13, where the handle attachment/detachment column part 11-8 is formed to protrude only on the upper surface of the rear opening side opposite to the connection column 11-3 of the slider body 11, a first handle attachment/detachment column part 11-8*c* is formed to protrude on the upper surface of the rear opening side, and a second handle attachment/detachment column part 11-8*d* is formed to protrude on the upper surface of the shoulder top side of the connection column 11-3 side. The configuration of the first and second handle attachment/detachment column parts 11-8*c* and 11-8*d* is substantially the same as those of the examples or the modified examples. In addition, the left and right cantilever engagement pieces 12-5 which are attached to or detached from the first and second handle attachment/detachment column parts 11-8*c* and 11-8*d* are not substantially changed from the examples or the modified examples. In the example, the pivot supporting portion 11-4 for supporting the pivot shaft 12-1 of the handle 12 is provided at the center of the upper surface of the upper wing plate 11-1 of the slider body 11, so that the positions of the handle 12 which is pivoted forward or backward to be laid down become front and rear object positions.

Although the function the first handle attachment/detachment column part 11-8*c* is not different from those of the handle attachment/detachment column parts 11-8 of the embodiments and the comparative example illustrated in FIGS. 1 to 13, since the second handle attachment/detachment column part 11-8*d* is provided, during the time of slider opening/closing manipulations, the handle 12 is allowed to be laid down to the rear opening side or the shoulder top side of the slider 10. In any case, the state where the handle 12 is laid down on the slider is maintained. Therefore, other adjacent members cannot be snatched by the handle 12, so that it is possible to prevent the slider 10 from indiscriminately sliding on the slide fastener. Accordingly, a task of installing, for example, a seat cover or the like can be easily performed.

In the aforementioned examples and modified examples illustrated, although a die-cast product which cannot easily elastically deformed is used as the handle 12, if the slider 10 formed using even the die-cast product having an advantage in terms of production cost has the aforementioned structure, it is possible to reduce the sliding range and the sliding time at the time of attaching or detaching the cantilever engagement pieces 12-5 to or from the handle attachment/detachment column parts 11-8, 11-8*c*, and 11-8*d* as described above, so that abrasion resistance can be improved. In addition, at the same time, since the left and right expansion/contraction sizes of the cantilever engagement piece can be suppressed to the minimum, even in the case of repetitive attachment/detachment manipulations, the so-called shear drop cannot easily occur, and the durability of the slider 10 can be greatly increased.

The present invention can be applied to various fields such as a seat cover member of a car, a medical product for sports, or shoes as well as a general use.

What is claimed is:

1. A slider for a slide fastener comprising:

a slider body and a handle of which one end is supported by a pivot supporting portion on an upper surface of the slider body;

wherein a window portion is formed in a handle main body of the handle;

wherein a pair of left and right cantilever engagement pieces are disposed to extend from one of inner edge portions of the window portion toward a facing inner edge portion; and wherein a handle attachment/detachment column part having an attachment/detachment head which is attached to or detached from the pair of the left and right cantilever engagement pieces in a snapped shape is disposed to protrude at least at a rear opening side on the upper surface of the slider body;

wherein the pair of the left and right cantilever engagement pieces have engagement portions with respect to the attachment/detachment head at facing inner side surfaces thereof;

in the engagement portion, at least a free end portion of each of the pair of the left and right cantilever engagement pieces is formed to have a slanted plane which is slanted downward with respect to a facing plane, and the engagement portions are configured to have a head receiving space which receives the attachment/detachment head at a time of engaging each of the cantilever engagement pieces with the attachment/detachment head.

2. The slider for a slide fastener according to claim 1, wherein a height of an upper surface of handle attachment/detachment column part from the upper surface of the slider is set to be equal to a height of an upper surface of the handle main body when the handle is engaged with the handle attachment/detachment column part.

3. The slider for a slide fastener according to claim 1, wherein a thickness between front and rear surfaces of each of the pair of the left and right cantilever engagement pieces is formed to be equal to a thickness between front and rear surfaces of the handle main body or to be smaller than the thickness between the front and rear surfaces of the handle main body.

4. The slider for a slide fastener according to claim 1, wherein the handle attachment/detachment column part is disposed on an upper surface of a shoulder top side of the slider body.

5. The slider for a slide fastener according to claim 1, wherein at least the handle is a die-cast product.

6. A slider for a slide fastener having a slider body and a handle of which one end is supported by a pivot supporting portion on an upper surface of the slider body, wherein a window portion is formed in a handle main body of the handle, wherein a pair of left and right cantilever engagement pieces are disposed to extend from one of inner edge portions of the window portion toward a facing inner edge portion, and wherein a handle attachment/detachment column part having an attachment/detachment head which is attached to or detached from the pair of the left and right cantilever engagement pieces in a snapped shape is disposed to protrude at least at a rear opening side on the upper surface of the slider body, wherein the pair of the left and right cantilever engagement pieces have engagement portions with respect to the attachment/detachment head at facing inner side surfaces thereof, the engagement portion is configured to have protrusions which are formed at free end portions of the pair of the left and right cantilever engagement pieces so as to protrude to approach each other, and the engagement portions are configured to have a head receiving space which receives the attachment/detachment head at a time of engaging each of the cantilever engagement pieces with the attachment/detachment head.

* * * * *